United States Patent [19]

Caufield

[11] Patent Number: 5,025,843

[45] Date of Patent: Jun. 25, 1991

[54] GOLF CLUB HEAD COVER KEEPER

[76] Inventor: Cavitt Caufield, 1010 W. 8th St., McGregor, Tex. 76657

[21] Appl. No.: 375,935

[22] Filed: Jul. 6, 1989

[51] Int. Cl.[5] ..... A63B 57/00

[52] U.S. Cl. ..... 150/160; 206/315.4

[58] Field of Search ..... 150/160, 159; 206/315.4, 818, 315.3; 273/32 R, 32 B; 70/459; 403/DIG. 1

[56] References Cited

U.S. PATENT DOCUMENTS

| | | | |
|---|---|---|---|
| 2,772,902 | 12/1956 | Lind | 403/DIG. 1 X |
| 2,975,497 | 3/1961 | Budreck | 70/459 |
| 3,111,736 | 11/1963 | Budreck | 70/459 X |
| 3,128,812 | 4/1964 | Scheurer | 150/160 X |
| 3,294,138 | 12/1966 | Pawly | 150/160 |
| 3,415,518 | 12/1968 | Root | 273/32 R |
| 3,460,207 | 8/1969 | Stewart | 150/160 X |
| 3,466,049 | 9/1969 | Fox et al. | 403/DIG. 1 X |
| 3,638,284 | 2/1972 | Baker | 150/160 X |
| 3,682,216 | 8/1972 | Nelson | 383/11 X |
| 3,861,434 | 1/1975 | Harding | 150/160 |
| 3,938,570 | 2/1976 | Stewart | 150/160 |
| 4,126,166 | 11/1978 | Hohenstein | 150/160 X |
| 4,164,969 | 8/1979 | Dien | 150/160 X |
| 4,178,707 | 12/1979 | Littlefield | 273/32 R X |
| 4,296,787 | 10/1981 | Barton | 150/160 |
| 4,453,632 | 6/1984 | Clower | 150/160 X |
| 4,625,862 | 12/1986 | Clayton | 206/315.3 |
| 4,642,934 | 2/1987 | Carlson et al. | 383/11 X |
| 4,858,361 | 8/1989 | White | 206/818 X |

FOREIGN PATENT DOCUMENTS

| | | | |
|---|---|---|---|
| 510020 | 7/1939 | United Kingdom | 150/160 |

*Primary Examiner*—Sue A. Weaver

[57] ABSTRACT

A golf club head cover keeper that keeps head covers from being lost durng a round of golf. The keeper is made to resemble a golf ball. The golf ball is divided into two halves that are joined together with magnets. The ends of each are connected to head covers through snap rings. When the cover is removed from the club it and the keeper are simply attached to another magnetized sphere half and the covers are thereby kept together.

3 Claims, 5 Drawing Sheets

GOLF CLUB HEAD COVER KEEPER

BACKGROUND OF THE INVENTION

Golf club head covers have an annoying tendency to get lost. There are a number of patents in the prior art that relate to the head covers on golf clubs. Some attempt to keep the covers together through cords or laces. U.S. Pat. Nos. 3,128,812; 4,164,969; 3,638,284; 3,294,138; 4,126,166; 3,460,207 and 3,861,434 are some examples.

In some of these prior art devices the cords thongs, and hooks tangle with the other clubs or with each other and are soon done away with. Others have tried hook and latch closures (these are known as VELCRO, a registered trademark) but these are difficult to work with because the patch has to be made on to the bag or manufactured on to the cover existing head covers cannot easily be sent back to the maker for retooling. These patches also tend to attract grasses, hairs, and dirt and are difficult to wash, especially the VELCRO ones.

SUMMARY OF THE INVENTION

It is among the objectives of the invention to provide the following;

A simple and efficient head cover keeper that is simple to use and can be easily adapted to present headcovers, and can be cheaply made. The instant invention can be readily attached to extant head covers by snapping the ring on the end of the keeper to an existing cover. No modification need be done to the golf bag. The compactness of the Cover keeper aids in its being easy to use and efficient. In some systems the user has to remove the cover before taking the club from bag because the cover is attached to the bag.

Another objective is to construct a head cover keeper that is made of rugged construction and does not wear out.

Still another is to have an attractive looking headcover keeper, one that can perhaps be marked to serve some useful, identifying function. Dirt, grass, etc have less chance of getting into the cover keeper as there is with VELCRO.

Another objective is to construct a cover keeper that can be removed and easily snapped to another cover. Because the holding force of the magnet almost never expires and the force is very strong, it is very easy to attach the keeper to metal objects with little fear that it will come off.

Still another objective is to provide a cover keeper that will remain in contact with the other head cover keepers throughout an afternoon of riding or walking around a golf course. The Cover keeper, being of metal construction, is more rugged than typical VELCRO flaps and more reliable because of the strength of the magnet.

DESCRIPTION OF THE INVENTION

Figure 1:
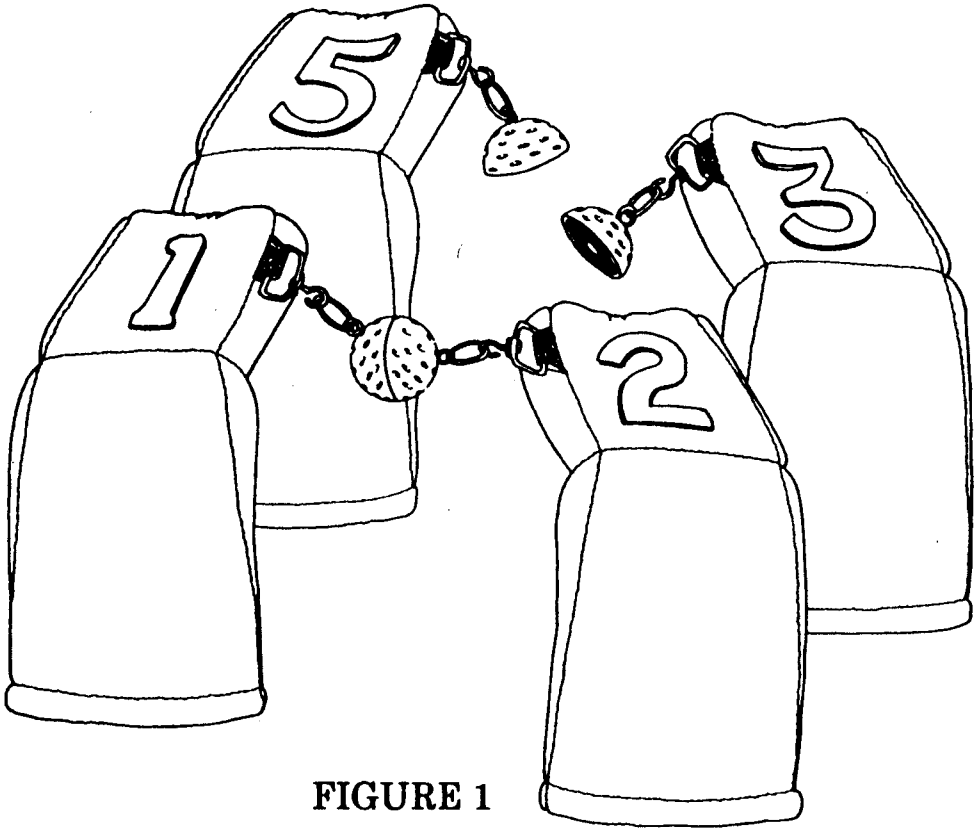
FIG. 1 shows the head cover keepers in use.
Figure 2:
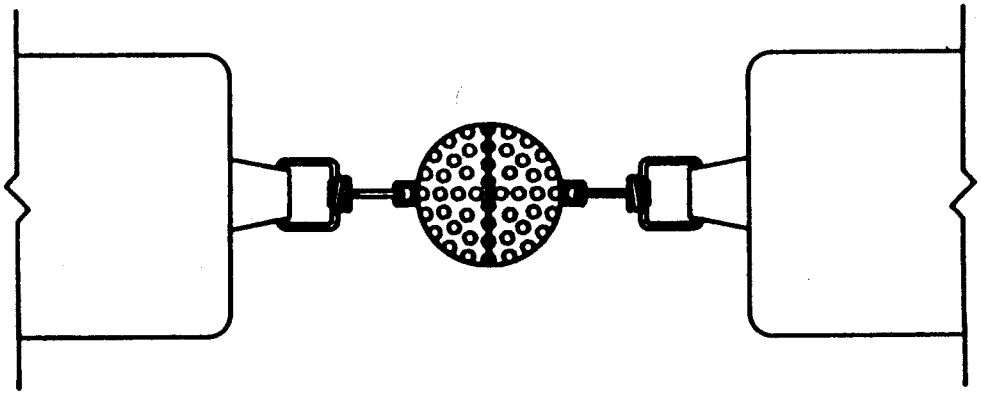
FIG. 2 shows the overall construction of the cover keeper
Figure 3:
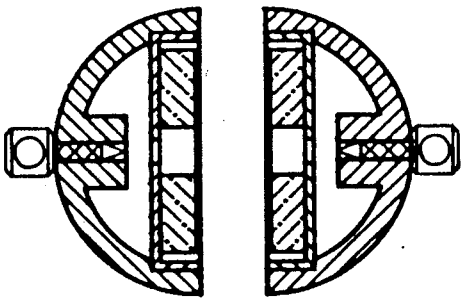
FIG. 3 shows a cut away view of the cross section of the keeper
Figure 4:
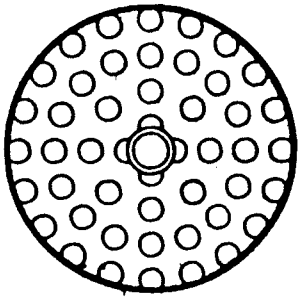
FIG. 4 shows the top of a sphere half.
Figure 5:
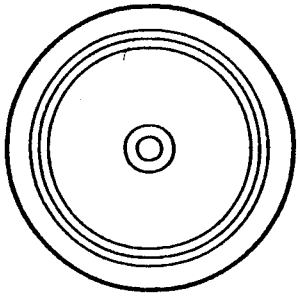
FIG. 5 shows the bottom of a sphere half showing the magents.

The cover keeper is for use on golf club head covers. It's purpose is to keep from losing the covers, this is a problem on all golf outings. The cover keeper looks like a golf ball cut in half. It is attached to the head cover in a simple manner (see drawings) by the loop on top and a snap ring. When removing the cover from the club the cover keeper is put against another corresponding cover keeper, or on another club and is kept in place until replaced on club. This is done with the two magnets as shown in the attached drawings, and pictures.

The Cover Keeper is a half sphere, made to resemble a golf ball half, with magnet inside that keeps it in contact with a corresponding keeper. Each keeper has an attaching ring to attach to the golf head covers to prevent their loss. The cover keeper is about 1 and ½ inch in diameter with a magnet inserted in the sphere and an attaching ring. It is simple, easy to use, and very effective. See drawings.

The cover keeper is constructed in the following manner: A half sphere about the size of a golf ball is used as the base (see drawings). A metal cup with a rigid projection is secured into the sphere so that the projection goes through the back of the sphere and the cup faces outwards. A flat, circular magnet is placed in the cup and secured with epoxy or the like. That portion of the rigid projection that sticks out through the back of the sphere is made into a loop so that a snap ring can be attached to it. The snap ring is attached to the loop and then attached to the head cover.

USING THE INVENTION

The Cover Keeper is used to prevent the loss of golf club head covers. Golf clubs (woods) have covers to protect the woods from getting damaged. The covers (4) when removed from a wood are difficult to keep up with, and many are lost during a round of golf. The cover keeper is easy to use. When removing the cover from club, snap it up against one of the other 3 cover keepers and it stays there till snapped off and replaced on golf club. The two magnets will hold the two cover keepers together until pulled apart. They also will hold onto metal (steel) parts of cart or bag. No special holder is required. Unlike some methods, the club can be inserted into a cover while the covers are snapped together, then they are unsnapped and inserted into the bag. This can help to speed up the play.

The cover keeper can all be made of Alinco magnets, either flexible or hard. Can use magnets of different holding power. Magnets can be put in plastic with a metal cup or without a metal cup. Cover keepers will hold onto the metal clubs by tossing the cover keeper toward them.

Alternately, magnets can be used to hold together head covers in other ways. Small magnets can be used in conjunction with head covers that have strips of metal in them. Such combinations can be linked end to end. The snap ring could be snapped to the golfer's pants and then joined to another head cover. Of course the keeper does not have to be in the shape of a golf ball, other imaginative shapes are possible. Many sorts of materials are possible, for example, clear plastic can be used with identifying marks on the inside.

I claim:

1. A magnetized device for golf club heads comprising: A cover portion to be placed over said golf club head, loop means attached to an outside portion of said cover portion, magnetized means removably connected to said loop means by connecting means so that said magnetized means can be removed from said cover portion.

2. The apparatus of claim 1 where said connecting means is a snap hook.

3. The apparatus of claim 1 where said magnetized means is in the shape of a sphere half.

* * * * *